US005926103A

United States Patent [19]

Petite

[11] Patent Number: 5,926,103

[45] **Date of Patent: *Jul. 20, 1999**

[54] PERSONALIZED SECURITY SYSTEM

[76] Inventor: T. David Petite, 6586 Oakwood Dr., Douglasville, Ga. 30135

[ * ] Notice: This patent is subject to a terminal disclaimer.

[21] Appl. No.: 08/943,773

[22] Filed: Oct. 6, 1997

Related U.S. Application Data

[63] Continuation-in-part of application No. 08/605,649, Feb. 22, 1996, Pat. No. 5,714,931, which is a continuation of application No. 08/243,263, May 16, 1994, abandoned.

[51] Int. Cl.[6] ..... G08B 1/08

[52] U.S. Cl. ..... 340/825.19; 340/539; 340/573.1; 340/531; 340/825.72; 340/825.49; 358/93; 348/143

[58] Field of Search ..... 340/825.19, 539, 340/573, 531, 825.72, 825.49; 358/93; 348/143

[56] References Cited

U.S. PATENT DOCUMENTS

| | | | |
|---|---|---|---|
| 3,665,475 | 5/1972 | Gram | 343/225 |
| 3,723,876 | 3/1973 | Seaborn, Jr. | 325/64 |
| 3,848,231 | 11/1974 | Wootton | 340/164 R |
| 3,914,692 | 10/1975 | Seaborn, Jr. | 325/53 |
| 3,925,763 | 12/1975 | Wadhwani et al. | 340/164 R |
| 4,083,003 | 4/1978 | Haemmig | 325/6 |
| 4,396,910 | 8/1983 | Enemark et al. | 340/539 |
| 4,446,454 | 5/1984 | Pyle | 340/538 |
| 4,468,656 | 8/1984 | Clifford et al. | 340/539 |
| 4,611,198 | 9/1986 | Levinson et al. | 340/539 |
| 4,670,739 | 6/1987 | Kelly, Jr. | 340/539 |
| 4,884,132 | 11/1989 | Morris et al. | 358/93 |
| 4,952,928 | 8/1990 | Carroll et al. | 340/825.54 |
| 4,998,095 | 3/1991 | Shields | 340/574 |
| 5,055,851 | 10/1991 | Sheffer | 342/457 |
| 5,086,391 | 2/1992 | Chambers | 364/413.02 |
| 5,115,224 | 5/1992 | Kostusiak et al. | 340/574 |
| 5,204,670 | 4/1993 | Stinton | 340/825.54 |
| 5,223,844 | 6/1993 | Mansell et al. | 342/357 |
| 5,305,370 | 4/1994 | Kearns et al. | 379/45 |
| 5,334,974 | 8/1994 | Simms et al. | 340/990 |
| 5,365,217 | 11/1994 | Toner | 340/539 |
| 5,467,074 | 11/1995 | Pedtke | 340/539 |
| 5,548,632 | 8/1996 | Walsh et al. | 379/58 |
| 5,555,258 | 9/1996 | Snelling et al. | 370/29 |
| 5,714,931 | 2/1998 | Petite et al. | 340/539 |

FOREIGN PATENT DOCUMENTS

| | | | |
|---|---|---|---|
| 2247 761 A | 3/1992 | United Kingdom | G08B 25/10 |

OTHER PUBLICATIONS

Statsignal brochure, "*Commonly Asked Questions*", 1996.

*Primary Examiner*—Brian Zimmerman
*Assistant Examiner*—Yves Dalencourt
*Attorney, Agent, or Firm*—Troutman Sanders LLP

[57] ABSTRACT

A personalized security system in which a portable transmitter may be carried or worn by an individual and activated by the individual when in need of assistance to transmit data relating specifically to the individual. The data is received by a transceiver located in close proximity to the individual such as at an ATM, pay phone, gas pump or personal computer and is transmitted with additional data to a remote receiver. The remote receiver then forwards information relating to the data to emergency personnel who use the information to determine the location of the individual, as well as particulars relating specifically to the individual, such as name and physical description.

24 Claims, 5 Drawing Sheets

PERSONALIZED SECURITY SYSTEM

This application is a continuation-in-part of U.S. application Ser. No. 08/605,649 filed Feb. 22, 1996, now U.S. Pat. No. 5,714,931 which is a continuation of U.S. application Ser. No. 08/243,263 filed May 16, 1994, now abandoned.

BACKGROUND OF THE INVENTION

1. Field of the Invention

The present invention relates to security systems. More specifically, the present invention relates to personalized security systems in which a portable transmitter may be carried or worn by an individual and activated by the individual in need of assistance to transmit data relating specifically to the individual. The data is received by a transceiver located in close proximity to the individual and is transmitted along with additional data to a remote receiver. The remote receiver then forwards information relating to the data to emergency personnel who use the information to determine the location of the individual, as well as particulars relating specifically to the individual, such as the individual's name and physical description.

2. Description of Related Art

Emergency situations, such as burglaries, fires, and sickness have previously given rise to the introduction of a variety of remote emergency warning systems. For example, many homeowners use security systems which are installed in the home and can be remotely monitored. These systems typically have the ability to indicate the type of assistance needed, such as the police, fire department, or an ambulance, and the location of the home where the emergency situation exists. A drawback of these systems is that they are of no use once the individual leaves his or her home.

Modern day trends show an increase in random acts of violence, such as robbery, assault, and battery. For this reason, personal remote emergency warning systems have also been introduced. These systems typically allow an individual to carry or wear a transmitter which may be manually or automatically activated when the individual encounters an emergency. Once activated, the transmitter typically sends a signal containing information identifying the particular transmitter and the nature of the emergency to a remote transceiver which forwards the information to emergency personnel.

A drawback of these latter systems is that no data relating specifically to the individual is transmitted by the transmitter. Therefore, though emergency personnel could identify the transmitter and the nature of the emergency, no information regarding the user, such as the name of the user, the description of the user, the user's vehicle tag number, and the like, is immediately available to the emergency personnel. Due to this inadequacy, precious time may be wasted as the emergency personnel arrive at the scene of an emergency with no information regarding the individual they have arrived to assist.

SUMMARY OF THE INVENTION

In accordance with the teachings of the present invention, a new system for personalized security is provided. The present invention overcomes the inadequacies of prior art personalized security systems by providing a means for transmitting data related specifically to a user of the system to emergency personnel when assistance is needed. For example, an individual at an Automated Teller Machine (ATM), pay phone, gas pump or even at home could notify the police of a robbery as it is occurring, whereby the notice to the police includes the location of the crime, the individual's name, address, a description of the individual, the individual's vehicle tag number and much more. By having this information immediately accessible, the police could then more precisely and efficiently act to rescue the individual.

The system includes a portable transmitter, a transceiver, and a remote receiver. The portable transmitter sends a signal containing the personalized data to a nearby transceiver, the transceiver forwards the data to a remote receiver, and the remote receiver forwards the data to the emergency personnel.

The portable transmitter is a hand held unit, which may be very small such that it is easily carried in an individual's pocket or on a key ring. The personal transmitter preferably transmits a Frequency Shift Key ("FSK") modulation signal to the transceiver, where the signal contains data relating to a distinct user identification code. In addition, the signal may also include other data specific to the individual such as the individual's name, address, telephone number, description, vehicle tag number, vehicle identification number, LOJACK® number, nearest relative, etc.

The transceiver receives the data from the portable transmitter, decodes the data, and adds data related to the location of the transceiver. The transceiver then transmits the data to the remote receiver, preferably over a telephone line via a modem. The location of the transceiver is anywhere in the area proximate to where the individual activates the personal transmitter. For example, the transceiver may be located in an ATM, pay phone, personal computer or in a building such as a bank or grocery store in the vicinity of the individual.

The remote receiver receives the data and uses a database to obtain any further data relating to the user and to obtain information on the emergency personnel closest to the location of the transceiver. The remote receiver then transmits the data to the emergency personnel identified from the database, such as the closest police department. The emergency personnel may then provide more efficient and precise assistance to the individual activating the system due to the personalized data.

One example of a situation in which the personalized security system of the present invention would provide improved security is a robbery and kidnapping situation at an ATM or pay phone. For instance, if a user is attacked at a pay phone, the user may activate the system, and emergency personnel will be quickly notified of the particulars on the user. Therefore, police can be notified to be on the lookout for an individual and a car meeting certain descriptions. With this information, the police might catch the criminal driving off with the user, in the user's car, or both.

In another example, if a user experiences a medical emergency in a crowded public area in the vicinity of an ATM or pay phone, medical personnel may be summoned quickly. The medical personnel may then arrive at the scene with the physical description and medical history of the individual in need of assistance. In accordance with another aspect of the present invention, multiple signal repeaters may be used to relay the signal from the transmitter to the receiver or another repeater. This feature is particularly useful where an emergency is encountered in an area which is not in the immediate vicinity of an ATM or pay phone equipped with the transceiver of the present invention. In accordance with yet another aspect of the invention, an optional video camera is connected to the transceiver so that video images capturing the scene of a crime or emergency can be transmitted to emergency personnel.

The aforementioned and other aspects of the present invention are described in the detailed description and attached illustrations which follow.

DESCRIPTION OF THE PREFERRED EMBODIMENTS

Figure 1:
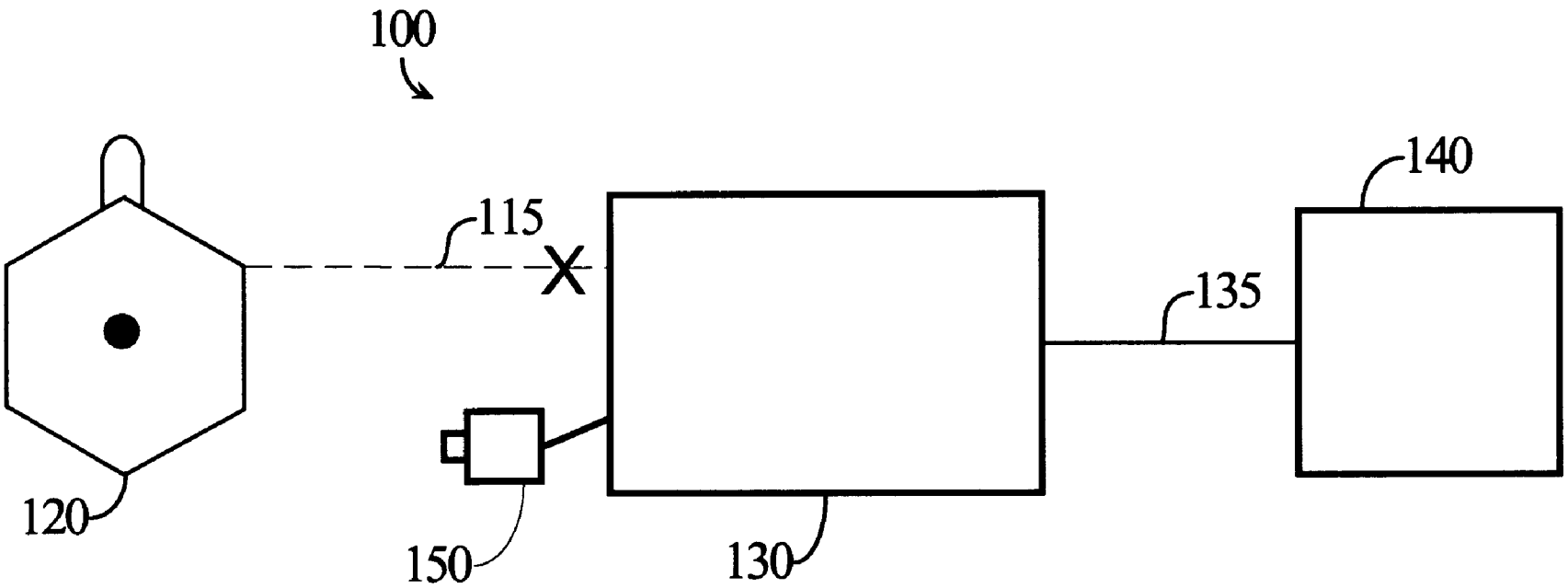
FIG. 1 is a block diagram illustrating the interaction between the portable transmitter, the transceiver, and the remote receiver.

The following is a preferred implementation of the personalized security system 100 of the present invention. As shown in FIG. 1, the system 100 includes a portable transmitter device 120, a transceiver 130, and a remote receiver 140. The portable transmitter device 120 transmits a signal 115 containing data specific to an individual to the transceiver 130. The signal is then decoded by the transceiver 130 and forwarded with additional data over a telephone line 135 to the remote receiver 140. Emergency personnel are then notified by the remote receiver 140 of the location and the particular individual needing assistance.

Figure 2:
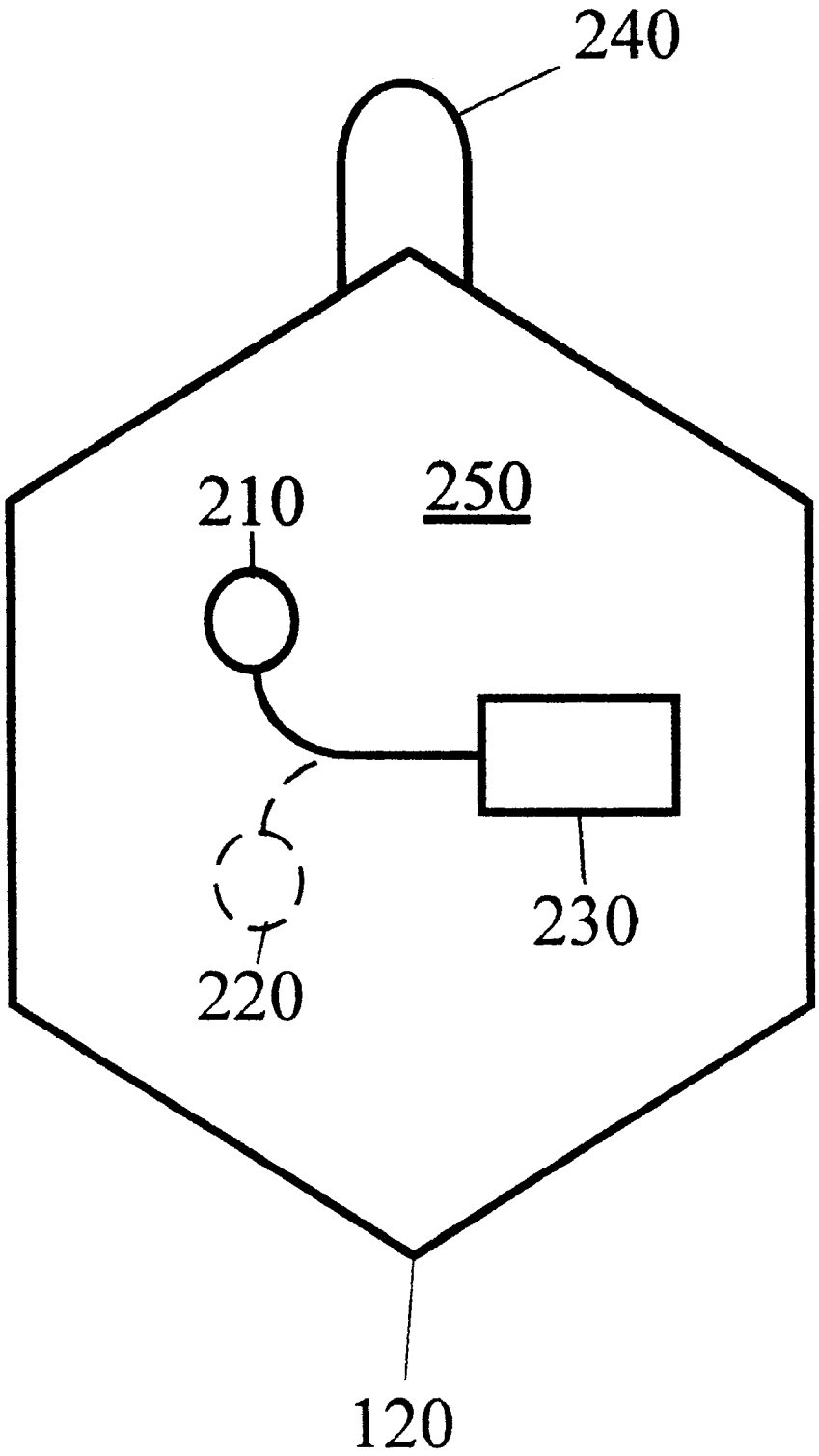
FIG. 2 is a more detailed block diagram of the portable transmitter shown in FIG. 1.

The portable transmitter device 120 is a hand held unit for transmitting electromagnetic signals and may be carried or worn by an individual. The transmitter 120 preferably transmits RF signals to transceiver 130. However, those skilled in the art will appreciate that electromagnetic signals of different wavelengths such as ultrasonic or infrared, may be used. In one embodiment, the portable transmitter device 120 is encompassed in a plastic housing 250 as shown in FIG. 2. A ring 240 may be attached to the plastic housing 250 so that an individual can carry the portable transmitter device 120 on a key ring.

In one embodiment, the portable transmitter device 120 includes a top button 210 and a bottom button 220 which are mounted on the top and bottom, respectively, or other opposed sides of the plastic housing 250. The buttons 210, 220 are electrically connected to a RF transmitter 230 located within the portable transmitter device 120. When the two buttons 210, 220 are pressed simultaneously by the user, the transmitter 230 is activated.

In a second embodiment, the portable transmitter includes two or more top buttons 210 and one bottom button 220. In this embodiment, each of the top buttons represents a particular type of function or emergency condition. For example, the first top button 210 could represent that police assistance is needed and the second top button 210 could represent that medical assistance is required. While it is impossible to describe every conceivable type of emergency condition in which the present invention may be used, it will clear to those skilled in the art that other top buttons 210 could represent a fire, automobile trouble, a diagnostic test (system check) or one of many other conditions. When a top button 210 and bottom button 220 are pressed simultaneously, the transmitter 230 is activated and a unique signal indicating the type of emergency condition is sent to the transceiver 130 (see FIG. 1). Though the simultaneously-pressed-buttons configuration for activating the transmitter is described for the embodiments set forth above, those of ordinary skill in the art will appreciate that there are many other equivalent means that could be used for the same purpose.

The transmitter 230 preferably transmits an FSK tone modulation signal 115 (see FIG. 1), similar to that of a cellular phone, which preferably has a range of at least 150 feet. However, other suitable modulation schemes may be used. In one embodiment, the signal transmitted contains a distinct identification code for the user. The PT-2D portable transmitter device available from Transcience of Stamford, Conn. may be utilized to transmit up to 65,536 distinct four-digit codes to identify the user. The PT-2D uses dip switches located on the exterior of the portable transmitter device 120 to set the user identification code.

In another embodiment, the portable transmitter device 120 includes a Read Only Memory (ROM) device in which the user identification code is pre-programmed into the portable transmitter device 120. This embodiment improves on the PT-2D because the number of user identification codes for the personalized security system of the present invention would no longer be limited by the number of dip switches. Further, the user would no longer have the capability to intentionally or accidentally flip a dip switch thereby sending an improper user identification code when the portable transmitter device 120 is activated.

In yet another embodiment, the transmitter 230 transmits the signal containing two or more data elements stored in ROM where the data elements are specific to the user. These data elements may include the user's identification code, name, address, description, digitized picture, medical condition, vehicle tag number, vehicle identification number, LOJACK® number, nearest relative or friend, and much more.

Though preferred embodiments for transmitting a signal with data related specifically to the user are described, one of ordinary skill in the art would appreciate that other types of transmitters may be used. For example, a transmitter that transmits a satellite signal, and a transmitter that transmits billions of distinct codes to identify different users may be used in the personalized security system of the present invention.

Figure 3:
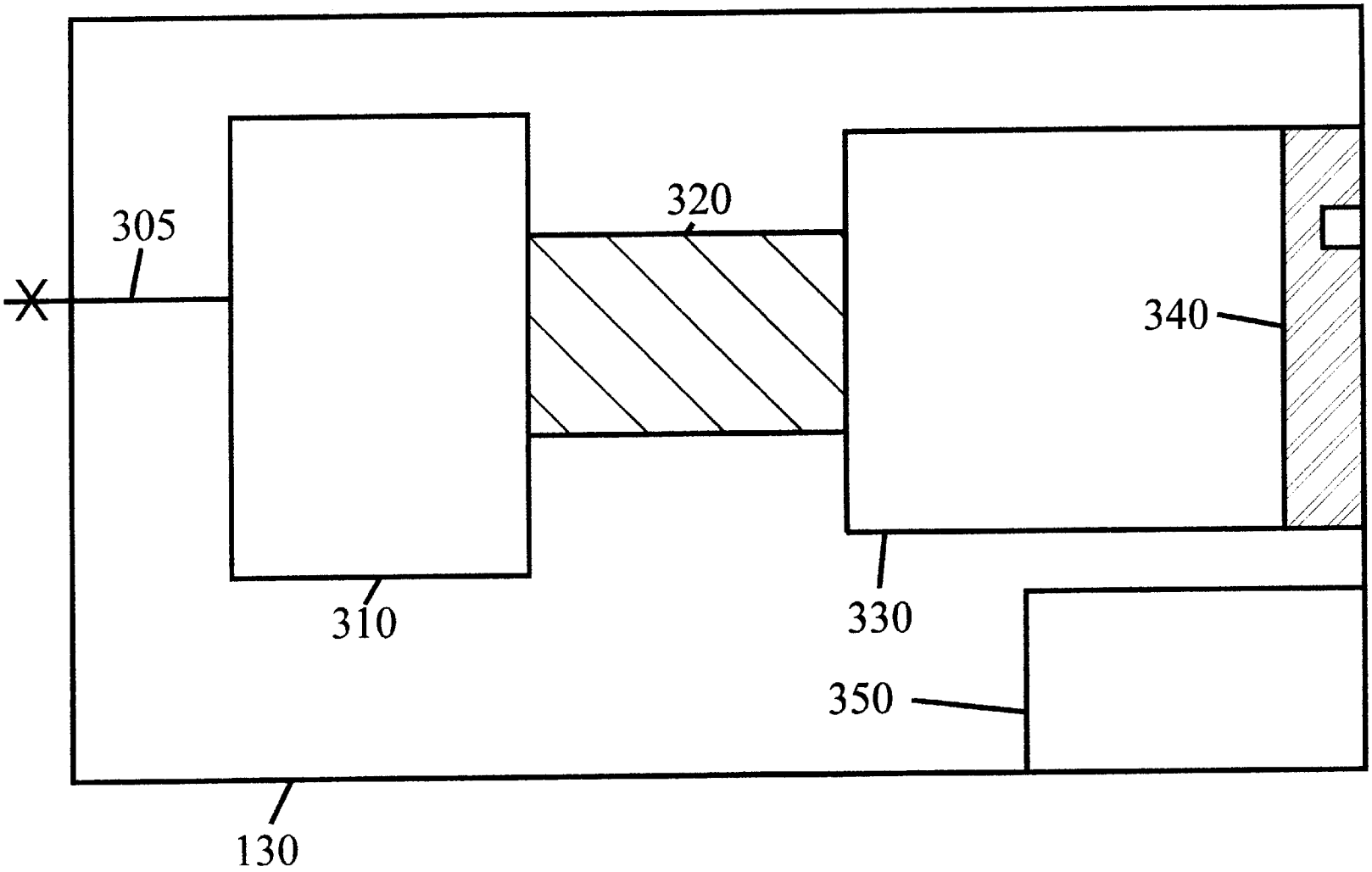
FIG. 3 is a more detailed block diagram of the receiver shown in FIG. 1.

Referring now to FIGS. 1 and 3, it is noted that the transceiver 130 receives the data from the portable transmitter 120, decodes the data, and adds data related to the location of the transceiver 130. The data is then transmitted by the transceiver 130 to the remote receiver 140. Preferably the transceiver 130 transmits a bit stream which includes the personal ID of the user as received from the transmitter, an identification code for the transceiver, a function code corresponding to the type of button pressed on the transmitter (panic, test, etc.), and a checksum. Alternatively, this protocol may have an open-ended architecture which is adapted to accommodate bit streams of varying lengths so that new functions and features can be added to security system in the future as the need for such arises and technology further develops.

In one embodiment, the transceiver 130 includes an antenna 305, a receiver/decoder 310, an interface unit 320, a central processing unit (CPU) 330, a modem 340, and a battery pack 350. For external mountings, the transceiver 130 components may be housed in a metal box or any other housing that accommodates electrical components. For internal mountings, such as a personal computer, pay phone or ATM, the transceiver components may be manufactured onto a small circuit board.

The signal sent by the portable transmitter device 120 is received by the antenna 305. The antenna 305 is coupled to the receiver/decoder 310 and is capable of receiving a FSK tone modulation signal. In one embodiment, referred to as the remote antenna embodiment, the antenna 305 is mounted to the top of a structure, such as a bank or grocery store, and wiring, such as coaxial cable, is used to connect the antenna 305 to the receiver/decoder 310. In a second embodiment, referred to as the solid mount embodiment, the antenna is mounted to the transceiver box housing the components of the transceiver 130, and wiring is used to couple the antenna 305 to the receiver/decoder 310.

The receiver/decoder 310 receives the signal 115 (see FIG. 1) from the antenna 305. The data within the signal 115 is then decoded by the receiver/decoder 310 and forwarded to the interface unit 320. The interface unit 320 receives the data from the receiver/decoder 310 and conditions the data for the CPU 330. The data is then forwarded by the interface unit 320 to the CPU 330.

The CPU 330 includes memory capacity to store at least 65,536 four-digit user identification codes, but preferably billions of user codes and other data such as digitized video images captured by video camera 150. The user codes are downloaded from the remote receiver 140 (see FIG. 1) to CPU 330 as users (subscribers) are added to and deleted from the system.

The transmitter 120 and receiver 130 must be in synchronization so that the bit stream transmitted is correctly decoded. Thus, the first few bits of data transmitted when a button is pressed are synchronization bits. Then a data packet is sent by transmitter 120. Upon receipt of the packetized data by the transceiver 130, CPU 330 performs a checksum operation to ensure proper data transmission. If the data is properly received, the user identification code is verified using the user identification codes stored in the CPU 330. If the user identification code is not authenticated, the data is discarded. This might occur, for example, if the data was generated by a signal from a garage door opener. If the user identification code is confirmed and validated, the transceiver checks to determine if the function code indicates that a panic button (or another emergency-type button) was pressed. If so, the transceiver immediately loads the user's personal ID code along with the transceiver ID and function code into RAM and goes into a transfer mode to transfer this information via the modem 340 to the receiver 140 at a central monitoring station by dialing one of several pre-determined telephone numbers which may be stored in CPU 330. The information is preferably transferred to the receiver 140 in ASCII format at 1200 bps or higher. As soon as the transmission from the transceiver 130 to the receiver 140 is completed, the modem 340 will disconnect and the transceiver 130 will go back to an idle mode awaiting the next activation of the transmitter 120.

The transceiver 130 may be programmed to dial different numbers depending on which button was pressed. For example, a number may be dialed in response to an ATM button being pressed so as to conduct a financial transaction. If there is a busy signal upon dialing, the transceiver 130 will command the modem 340 to continue to dial for a preset number of times. The number of dialing attempts and other features such as the transceiver ID code are programmable and can preferably be changed by remotely accessing the transceiver 130 via telephone. Of course, a security code is preferably required to change such features.

The modem 340 is a standard telephone modem. Once the modem 340 receives the conditioned data and the command to dial the remote receiver 140 from the CPU 330, the modem 340 transmits a "Request for Assistance" over telephone line 135 to the remote receiver 140. After the modem 340 receives an acknowledgment from the remote receiver 140, the modem 340 transmits the conditioned data and optional video images to the remote receiver 140 over telephone line 135, preferably in ASCII.

The RT-232 receiver/decoder device available from Transcience which recognizes up to 65,536 distinct codes, may be used for the transceiver 130. However, as one of ordinary skill in the art would appreciate, an equivalent device or one which recognizes billions of distinct user codes could also be used. Also, it would be readily understood by one of ordinary skill in the art that the transceiver 130 may communicate with the remote receiver 140 over many equivalent means other than telephone lines, such as cellular and satellite links.

In a second embodiment, the CPU 330 of the transceiver 130 also includes memory capacity to store data elements for different users. The transceiver 130 then uses the data, such as the user identification code or any other data element related to the user, received from the portable transmitter device 120 and database software, to obtain additional data in connection with the user. This data may include a digitized photograph and information related specifically to characteristics of the user such as size, weight, height, hair color, eye color, birth marks, age, medical history, and race. Moreover, this data may include information on the user's vehicle, such as type, model, year, color, tag number, identification number, and LOJACK® number. Further, the data may include information on the user's nearest relatives and friends and much more user specific information. The CPU 330 may then append the additional data to the conditioned data and forward all of the data to the remote receiver 140.

The transceiver 130 is located in close proximity to the place where the user activates the portable transmitter device 120, preferably within one hundred fifty feet. The structure for locating the transceiver 130 may be almost any structure, including an ATM, a pay phone, a personal computer, a bank, a grocery store, or the like. The transceiver 130 may be mounted on a wall, floor or almost anywhere else. The structure on which the transceiver 130 is located preferably includes a 110 volt electrical outlet and a telephone line.

In another embodiment the transceiver 130 is mounted in a personal computer. In this embodiment, the components of transceiver 130 are preferably provided as add-on items for a standard IBM-compatible PC motherboard. As such, the motherboard could also preferably include a built-in receiver unit, modem, and associated antenna which are capable of receiving a user's personal code from transmitter 120 and transmitting data to receiver 140. This embodiment allows a user of the personalized security system 100 of the present invention to use a personal computer as a security device. In this regard, various RF sensors associated with security systems (such as window and door sensors) may be connected to the personal computer so that when a sensor is activated, an RF signal is sent to the personal computer uniquely identifying the location of the security breach. Therefore, this embodiments has two means of activating the system of the present invention—via the transmitter and via the various RF sensors mounted on windows, doors, etc.

Moreover, a subscriber may use the portable transmitter 120 to activate the personalized security system 100 with the transceiver 130 from different types of locations whether at home via a personal computer, at an ATM or at a pay phone. Even if the user is at the home of a friend, the system may be activated to indicate that the user has activated the system from that friend's home so long as the friend's personal computer is equipped with the personalized security system 100 of the present invention.

The transceiver 130 is preferably powered by 110 volts AC. However, a battery pack 350 with a charger is also included in the transceiver 130 to provide backup power should a power outage occur. In one embodiment, the battery pack 350 provides 12 volts, 12 amps, and 24 hours of power. In another embodiment, the battery pack 350 provides 12 volts, 15 amps, and 48 hours of power. In yet another embodiment, the battery pack 350 is the sole source of power for transceiver 130.

Figure 4:
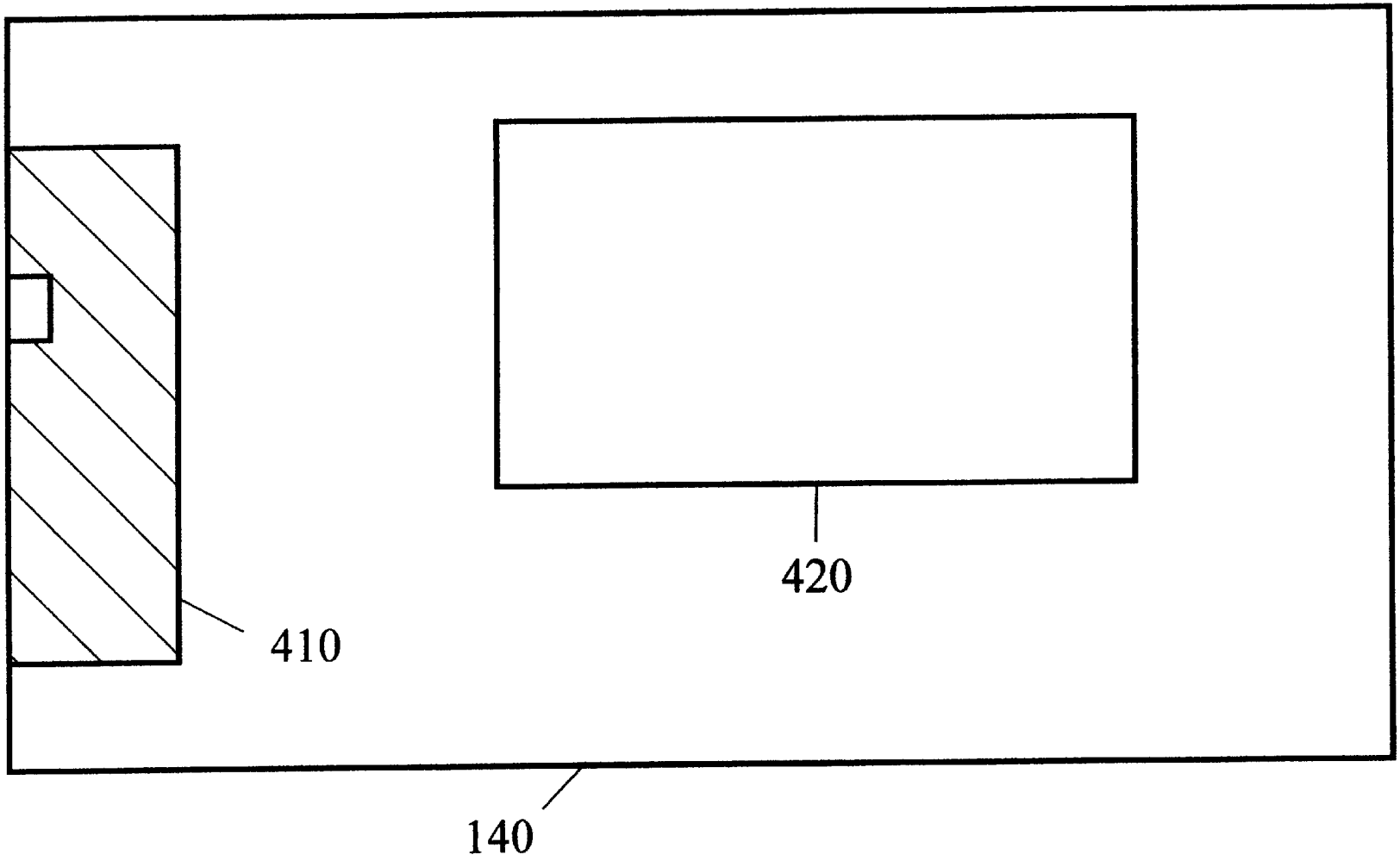
FIG. 4 is a more detailed block diagram of the remote receiver shown in FIG. 1.

Referring now to FIG. 4, the remote receiver of the present invention is shown. The remote receiver 140 is preferably located at a central monitoring station which is capable communicating with multiple transceivers at different locations. The remote receiver 140 is a computer which includes a modem 410 and a CPU 420. The remote receiver 140 uses database software and the CPU 420 to store further data related specifically to the users of the personalized security system 100 of the present invention, as well as data related to emergency personnel.

The remote receiver 140 receives the data from the transceiver 130 over the telephone line 135 via the modem 410, and uses the database software and the user's identification code or any other data element related to the user to obtain further information specific to the user. This information may include a digitized photograph of the user and information on characteristics of the user such as size, weight, height, hair color, eye color, birth marks, age, medical history and race. Moreover, this information may include information on the user's vehicle such as type, model, year, color, tag number, identification number, and LOJACK® number. Further, the information may include the user's nearest relatives and friends and much more user specific information. Finally, the location identifier data element for the transceiver 130 may be used to obtain information from the database on the address where the transceiver 130 (see FIG. 1) is located, the cross-streets nearest to the transceiver 130, and the emergency personnel, such as the police department, fire department, and ambulance, closest to the transceiver 130.

The remote receiver 140 may then use the modem 410 to notify the emergency personnel closest to the transceiver 130 about the user in need of assistance. During the notification process, the information relating specifically to the user who activated the portable transmitter device 120 (see FIG. 1) is sent to the emergency personnel. The emergency personnel are then able to provide more efficient and precise assistance to the user of the personalized security system 100 of the present invention. In addition, the provision of video images by surveillance camera 150 will be of invaluable assistance both while responding to the scene and during any subsequent criminal proceedings which may be necessary. Thus, users of the personalized security system 100 of the present invention may choose to subscribe to the optional service of providing real-time transmission of video images from the camera located at transceiver 130 or, alternatively, obtaining video copies of the images recorded during an incident. As one of ordinary skill in the art would appreciate, the remote receiver 140 may communicate with the emergency over many equivalent means, such as cellular and satellite links. Moreover, communication with emergency personnel may include direct communication with police officers in their cars, firemen in their fire trucks, and many others with access to communications links.

In addition to identifying pertinent user information and notifying emergency personnel, the remote receiver 140 may store the time, date, transceiver location, and video images associated with each instance the personalized security system 100 is activated. Further, activated and deactivated user identification numbers may be downloaded by the remote receiver 140 to the CPU 330 of the transceiver 130 (see FIG. 3). Moreover, the remote receiver 140 may perform random operation checks on the transceiver 130.

Figure 5:
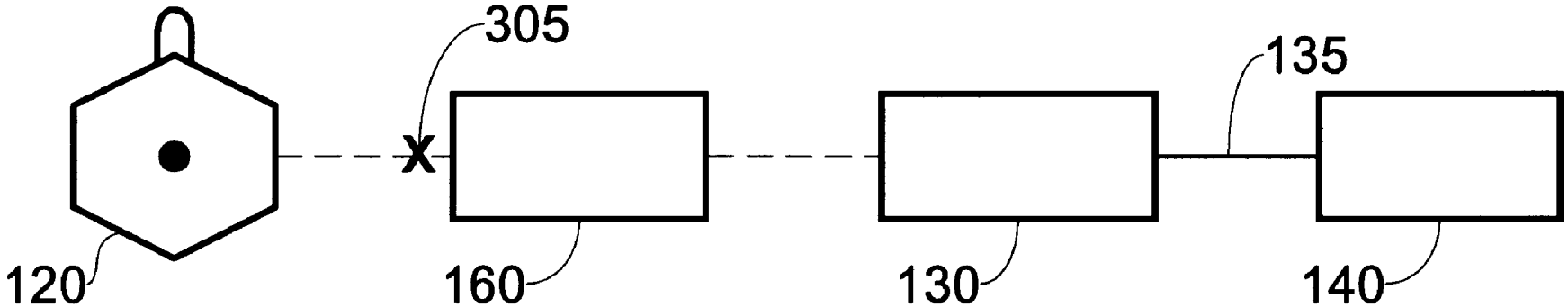
FIG. 5 is a block diagram of an alternative embodiment of the present invention which includes a repeater for relaying signals received from the transmitter to the transceiver.

Referring now to FIG. 5, it is shown that for applications of the present invention where it is necessary to transmit signals to the transceiver 130 from longer distances, for example, greater than about one-hundred fifty feet, the invention provides one or more repeaters or relay stations 160 positioned between the transmitter 120 and the transceiver 130 for receiving and retransmitting signals. Like the transceiver, the repeater has a transmitter and a receiver in it and monitors in a manner similar to the transceiver 130. The receiver section in the repeater checks for an individual's ID code but does not perform a check to determine which button was pressed. Its merely checks to confirm that the signal that it received came from the transmitter or subscriber to the system of the present invention, or another repeater. If so, the repeater immediately re-transmits the signal out of its transmitter section preferably after a predetermined time delay. The time delay provides superior operation in situations where multiple repeaters are used in close proximity to one another by preventing the repeaters from transmitting at the same time, thus canceling each other out.

An illustrative location where the repeaters 160 of the present invention are useful is the typical ATM at a bank which also has a night deposit box located more than 150 feet from the ATM. If the transceiver 130 is physically located in the ATM and has a receiving radius of 150 feet, the only way to also protect the drop box is to either provide a second transceiver which requires another phone line, or to use a repeater. The repeater is ideal for this scenario because it is less expensive than a transceiver. The repeater can be placed in such a location that its range overlaps the transmitter's range and the tranceiver's location. As a result, when one is at the night deposit box beyond the range of the transceiver and presses a button on the transmitter, the transmitted signal is received by the repeater but not the receiver because the transmitter 120 is out of the receiver's range. The repeater then delays before sending the signal to the transceiver 130. The repeater validates the user's ID code and then retransmits the signal to the receiver or another repeater which would then transfer the signal until it ultimately reaches the transceiver. At this point, normal transceiver operation as described above takes place. The repeaters may optionally have unique ID codes if desired. In addition, a time stamp may be associated with activation of the repeater so that this information can be transmitted to the receiver enabling emergency personal, with aid of a CRT and appropriate mapping software, to track the movement of a person transmitting a distress signal, particularly when multiple repeaters are arranged in a grid such as in a mall parking lot. Such features and additional features are easily obtained with the open-ended protocol contemplated by the present invention which provides design flexibility and is not limited by the number of bytes.

Although the invention has been described in terms of preferred embodiments thereof, those skilled in the art will appreciate that many changes in structures and methods can be made without departing from the scope and spirit of the invention as set forth in the following claims.

I claim:

1. An assistance procuring system for use in combination with a pay telephone, the system comprising:

a portable transmitter including means for activation by a user, and means responsive to said activation means for transmitting a first signal, said first signal being encoded to uniquely identify the transmitter;

a transceiver integral with the pay phone and including means for receiving said first signal, and means for transmitting a second signal encoded to include transceiver location information and transmitter identification information derived from said first signal;

a remote station including a database having a plurality of updateable data elements including personal information relating to the user, the remote station further including means responsive to the second signal for indexably retrieving one or more of the data elements.

2. The assistance procuring system of claim 1, further comprising at least one repeater for receiving signals transmitted by said transmitter and retransmitting said signals to said transceiver.

3. The assistance procuring system of claim 1, wherein one or more of the plurality of data elements are selected from the group consisting of:

(a) the user's address;

(b) a description of the user;

(c) a digitized picture of the user;

(d) the user's vehicle tag number;

(e) the user's vehicle identification number;

(f) the user's vehicle LOJACK number;

(g) the user's nearest relatives or friends;

(h) the addresses of the user's nearest relative or friend;

(i) medical information of the user;

(j) an ID number assigned to the user; and (k) the user's name.

4. The system of claim 1 wherein said database includes one or more updateable elements relating to emergency personnel in the vicinity of said transceiver.

5. The assistance procuring system of claim 1 wherein said portable transmitter includes a memory device for storing data for producing said encoded signal.

6. The assistance procuring system of claim 1, wherein the portable transmitter further includes means for transmitting a set of one or more data elements representative of the nature of the assistance needed.

7. An assistance procuring system for use in combination with a pay telephone, said system including:

a portable transmitter for transmitting a first signal containing a first set of one or more data elements representative of personal information relating to a user;

a transceiver integral with said pay phone for receiving said first signal and for transmitting a second signal including said first set of said data elements and one or more additional data elements; and a remote station comprising:

a memory device adapted to store a plurality of updateable data elements corresponding to personal information relating to the user;

means for receiving said second signal; and means for generating a third signal corresponding to said first set of said one or more data elements, said one or more additional data elements, and said plurality of updateable data elements.

8. The remote station according to claim 7, wherein said plurality of data elements is organized in a searchable data base.

9. The remote station of claim 7 wherein said memory device further stores updateable information relating to emergency personnel located in the vicinity of said transceiver.

10. An assistance procuring system for use in combination with a personal computer, the system comprising:

a portable transmitter including means for activation by a user, and means responsive to said activation means for transmitting a first signal, said first signal being encoded to uniquely identify the transmitter;

a transceiver integral with the personal computer and including means for receiving said first signal, and means for transmitting a second signal encoded to include transceiver location information and transmitter identification information derived from said first signal;

a remote station including a database having a plurality of updateable data elements including personal information relating to the user, the remote station further including means responsive to the second signal for indexably retrieving one or more of the data elements.

11. The assistance procuring system of claim 10, further comprising at least one repeater for receiving signals transmitted by said transmitter and retransmitting said signals to said transceiver.

12. The assistance procuring system of claim 10, wherein one or more of the plurality of data elements are selected from the group consisting of:

(a) the user's address;

(b) a description of the user;

(c) a digitized picture of the user;

(d) the user's vehicle tag number;

(e) the user's vehicle identification number;

(f) the user's vehicle LOJACK number;

(g) the user's nearest relatives or friends;

(h) the addresses of the user's nearest relative or friend;

(i) medical information of the user;

(j) an ID number assigned to the user; and (k) the user's name.

13. The system of claim 10 wherein said database includes one or more updateable elements relating to emergency personnel in the vicinity of said transceiver.

14. The assistance procuring system of claim 10 wherein said portable transmitter includes a memory device adapted to store data for producing said encoded signal.

15. The assistance procuring system of claim 10, wherein the portable transmitter further includes means for transmitting a set of one or more data elements representative of the nature of the assistance needed.

16. An assistance procuring system for use in combination with a personal computer, said system including:

a portable transmitter for transmitting a first signal containing a first set of one or more data elements representative of personal information relating to a user;

a transceiver integral with said personal computer for receiving said first signal and for transmitting a second signal including said first set of said data elements and one or more additional data elements; and a remote station comprising:

a memory device for storing a plurality of updateable data elements corresponding to personal information relating to the user;

means for receiving said second signal; and means for generating a third signal corresponding to said first set of said one or more data elements, said one or more additional data elements, and said plurality of data elements.

17. The remote station according to claim 15, wherein said plurality of data elements is organized in a searchable data base.

18. The remote station of claim 16 wherein said memory device stores updateable information relating to emergency personnel located in the vicinity of said transceiver.

19. A personal security and monitoring system for notifying emergency personnel of the location and type of emergency condition being encountered by an individual activating the system, comprising:

a portable, battery-operated transmitter having at least one button connected to a RF transmitter for generating a modulated RF signal when said at least one button is pressed, said RF signal being encoded with bits of information including transmitter identification (ID) code and a function code identifying the type of emergency;

a transceiver having a receiver/decoder for receiving and decoding the RF signal from said transmitter via an antenna; an interface unit coupled to said receiver/decoder and a central processing unit (CPU) which authenticates the transmitter ID code and interprets the function code; said transceiver CPU further having data storage means which contains a unique transceiver identification code corresponding to the location of said transceiver; and a modem coupled to said transceiver CPU and a telephone line; and a receiver at a central monitoring station, said receiver having a modem in communication with said transceiver modem via the telephone line, and a receiver CPU for storing further data related specifically to nearby emergency personnel and users of the personal security and monitoring system.

20. The assistance procuring system of claim 19, further comprising at least one repeater for receiving signals transmitted by said transmitter and retransmitting said signals to said transceiver.

21. The personal security and monitoring system of claim 19, further comprising a video camera in close proximity to said transceiver and connected to said transceiver CPU so that video signals can be transmitted to the receiver at the central monitoring station.

22. The personal security and monitoring system of claim 21 wherein said receiver further includes a video monitor or recorder for viewing or storing said video signals.

23. The personal security and monitoring system of claim 19 wherein said transceiver is located at a facility selected from the group consisting of: a pay phone, a personal computer, an automatic teller machine, and a gas pump.

24. The assistance procuring system of claim 19, further comprising a plurality of repeaters for receiving signals transmitted by said transmitter and retransmitting said signals to said transceiver.

* * * * *